United States Patent [19]

Duran

[11] Patent Number: 4,834,172

[45] Date of Patent: May 30, 1989

[54] HEAT EXCHANGER

[75] Inventor: Don J. P. Duran, Murcia, Spain

[73] Assignee: W. Schmidt GmbH & Co. KG, Bretten, Fed. Rep. of Germany

[21] Appl. No.: 143,465

[22] Filed: Jan. 12, 1988

[51] Int. Cl.[4] ..... F28F 9/26

[52] U.S. Cl. ..... 165/143; 165/141; 165/155

[58] Field of Search ..... 165/143, 155, 141

[56] References Cited

U.S. PATENT DOCUMENTS

| | | | |
|---|---|---|---|
| 2,236,470 | 3/1941 | De Jonge | 165/143 |
| 2,706,106 | 4/1955 | Roswell | 165/155 |
| 3,889,746 | 6/1975 | Laffranchi | 165/155 |
| 4,146,088 | 3/1979 | Pain | 165/141 |

FOREIGN PATENT DOCUMENTS

| | | | |
|---|---|---|---|
| 0013700 | 8/1980 | European Pat. Off. . | |
| 132576 | 7/1902 | Fed. Rep. of Germany | 165/155 |
| 2748183 | 5/1979 | Fed. Rep. of Germany . | |
| 3133756 | 7/1982 | Fed. Rep. of Germany . | |
| 3153101 | 7/1982 | Fed. Rep. of Germany . | |
| 438879 | 5/1912 | France | 165/155 |
| 794469 | 2/1936 | France . | |
| 321833 | 12/1929 | United Kingdom . | |

*Primary Examiner*—Noah P. Kamen

*Attorney, Agent, or Firm*—Frishauf, Holtz, Goodman & Woodward

[57] ABSTRACT

A plurality of coaxially arranged, nested tubes (1, 2, 3, 4) are retained between distributor heads (8, 45). The heads and the outermost tube (1) are coupled to one another in a media-tight manner by fitting flanges to provide releasable axial connections. Each distributor head (9, 45) has two walls (9, 10, 46, 47) concentric to one another as well as one end chamber (17, 50) communicating with an annular chamber (11, 48, 49) formed between the walls. The outer wall (9) is joined to the outer tube (1), and the second tube (2), located inside the outer tube, is inserted into the inner wall (10) against an axial stop (24). A sleeve (26, 58, 59) is connected to a third, inner tube (3) located inside the second tube (2). The sleeve (26) is also braced against an axial stop (28) of the inner wall (10) close to the end chamber. The interior (34) of the sleeve communicates via an opening (19, 55) with the end chamber (17, 50). A first fluid media radial connection (15) is located between the inner wall (10) and the sleeve. Another medium is connected via an opening (18) of the end chamber. Two heads (8) may be coupled to form unitary twin head structures (FIGS. 10–15).

12 Claims, 9 Drawing Sheets

HEAT EXCHANGER

The invention relates to a heat exchanger having a plurality of tubes of thermally conductive material arranged coaxially with one another in a nest and spaced radially apart from one another, for heat exchange between at least two fluid media carried in the chambers formed between the tubes.

BACKGROUND

An attachment connection for the heat exchanger media and an end retaining means for the tubes is provided by distributor heads that are clamped into place, so that the tubes are coupled at the end in a fluid media-tight manner and are axially braced. These distributor heads have concentrically distributed interspaces that extend the chambers between the tubes as far as the attachment connections.

A heat exchanger of this type is known from U.S. Pat. No. 4,146,088, Pain, to which German Patent Disclosure Document DE-A No. 27 48 183 corresponds. The patent discloses heads which taper toward their end, oriented toward the nest of tubes, and form terrace-like stepped seat faces, on which the tubes are mounted, with sealing rings interposed inbetween, and where they rest on axial stops of the distributor heads. In the interior, the distributor heads form two diametrically opposed, crescent-shaped collecting chambers, which communicate via fitting radial bores with the particular interspace to be connected between two adjacent tubes of the nest of tubes. At the face end of the distributor heads remote from the nest of tubes, the crescent-shaped collecting chambers merge with two connection stubs, located adjacent one another, for the two media that are to be put into mutual heat exchange. The axial bracing of the nest of tubes between the two terminal distributor heads is effected via a tie rod that is guided centrally through the innermost tube and joins the two distributor heads to one another.

For disassembling, e.g. for cleaning, the tubes of the nest must be removed from the outside inwardly, which makes them very difficult to grasp and pull apart. The design of the distributor heads dictates the arrangement regarding the flow cross sections formed between adjacent tubes of the nest. It is thus impossible to retrofit a heat exchanger of the known type for different applications requiring, for example, different flow cross sections. The known heat exchanger is held together by means of a central tie rod. Thus, an additional component is required, which is costly and heavy.

A very considerable disadvantage of the known construction, however, is that the media to be involved in heat exchange must be supplied to the distributor heads via diametrically opposite collecting chambers which, thus, are completely separate from one another. The distributor chambers therefore do not participate in the heat exchange at all. This represents a considerable waste of space and material. The opposed arrangement of the collecting chambers also means that at the transition from a collecting chamber to the adjoining heat exchanger chamber, which extends over the complete circular cross section, the medium distributes itself over the entire heat exchange chamber only gradually, so that at each end of such a heat exchange chamber a space is left with practically no flow through it, forming a dead space; within this dead space, solids entrained by the medium can collect and become compacted, a development that is enhanced still further by the fact that the respective heat exchange chamber and the aforementioned collecting chamber communicate only via one or a few radial bores, of narrow cross section, of the distributor head. Accordingly, risk or, rather, the probability results, that after extended periods of operation, the tubes of the nest will be stuck together from solids compacted between their ends, so that when the heat exchanger is to be disassembled, they can be taken apart only by using force.

Finally, the connection stubs for the heat exchange media that extend axially parallel from the known distributor heads necessitate connecting series-connected heat exchangers to one another via interposed pipe segments and the like, which again means a considerable expenditure of material, space and labor for assembly.

THE INVENTION

It is therefore an object to form a heat exchanger of the type described above such that the distributor heads, in a manner comparable to the nest of tubes, likewise contribute fully to the heat exchange output; and that distribution of the media over the entire circumference of the heat exchanger is already assured in the distributor head, without dead spaces.

It is a further object to dispense with labor-intensive and space-wasting tie elements for holding the nest of tubes together between the two distributor heads; and finally, while existing components are largely retained, to permit easy retrofitting for different flow cross sections. Furthermore, heat exchangers connected in series with one another should be capable of easy communication in a space-saving manner.

Briefly, a nest of tubes is retained between distributor heads. Each distributor head has two substantially cylindrical, concentric walls, which are radially spaced from one another to define an essentially annular chamber between said walls, or, rather, a part-annular chamber. The walls are integrally connected by ribs extending between the walls. One end wall extends transversely from the outer wall and defines therebeneath an end chamber. The transverse end wall communicates with the essentially annular chamber, the end chamber thus extending inside the outer wall over the entire radial cross section thereof, which, in effect, is the radial cross section of the distributor head.

The outer wall of the distributor head is releasably coupled to the outer one of the plurality of tubes which form the nest of tubes. To permit rapid coupling and uncoupling, the outer wall and the outermost tube are connected by a coupling connection which generates an axial clamping force, for example by abutting two flanges which, then, are releasably clamped together, for example by a connecting ring. The inner wall is formed with two stops: a first stop supporting a second inner tube of the nest of tubes and being fitted thereagainst; a second stop, which is axially closer to the transversely extending wall, retains a hollow cylindrical sleeve, spaced radially from the inner wall of the head. The sleeve is open at the inside and forms an inner chamber which communicates with the end chamber of the distributor head. A third tube of the nest of tubes is coupled to the sleeve, by being sealed thereto.

A radially extending connecting portion connects the inner and outer wall, the connecting portion having a radial flow connection therein so that fluid communication can be established across the part-annular chamber to the second chamber, formed between the second and third tubes. The transversely extending wall of the head has, likewise, an opening therein to provide for flow communication to the outermost and innermost chambers.

This arrangement of a distributor head according to the invention has the advantage, first, of practically uninterrupted flow cross sections of the media flow in the circumferential direction between the outer and inner wall, on the one hand, and the inner wall and the sleeve on the other, as well as within the sleeve, so that the entire distributor head can already be fully effective as a heat exchanger without any dead spaces for the media flow, because the media are distributed over the entire inner circumference in the distributor head as well.

It is suitable to make the distributor head from thermally conductive material; it can also be made from glass, for example, however.

The nest of tubes is coupled to the distributor head in an extremely simple manner by the connection between the outer wall of the head and the outer tube of the nest of tubes. This connection presses the second tube and the sleeve simultaneously against axial stops of the inner wall of the distributor head, thus firmly seating them. This design also means that the length of the individual tube elements of the nest of tubes increases from the outside inwardly, so that upon disassembly, after the distributor head is removed, the individual tube ends are easy to grasp so that the tubes can be pulled apart.

Because of the retention of the inner, third tube via a sleeve, the third tube and the sleeve can form a set, in the manner of an interchangeable cartridge. Different cross sections of the third tube can then be selectively used without great difficulty, as long as the size of the attachment connection of the cartridge, at its seat against the axial stop of the inner wall of the head, is retained. The flow cross section between the inner, third tube and the second tube can thus be varied without difficulty and hence adapted easily to different requirements, while the remaining parts of the heat exchanger can continue to be used as before.

The flow carried in the interior of the third tube can be varied by using an inner element which also stabilizes and reinforces the cross section of the inner, third tube. The inside or clear cross section of the inner, third tube can be varied by using various inner elements.

A distributor head of the type according to the invention can very easily be subjected to X-ray examination, since the annular chamber between the outer and inner wall is easily accessible, for example for the insertion of X-ray film. In this way, defective distributor heads can readily be found and rejected, thus preventing defects from later causing expensive consequences.

Drawings, showing exemplary embodiments:

DETAILED DESCRIPTION

Figure 1:
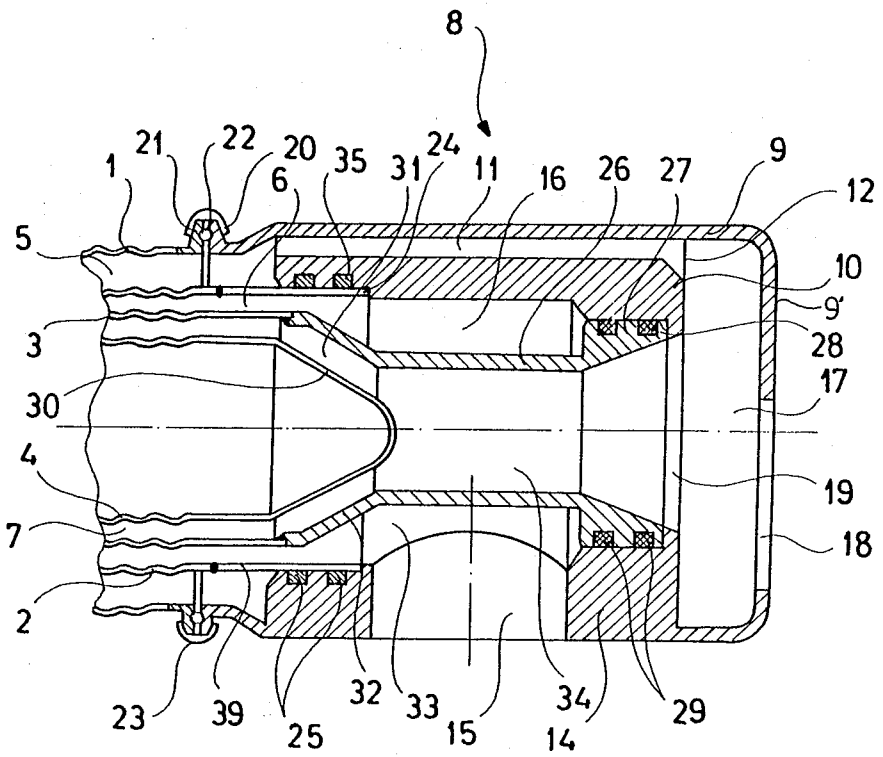
FIG. 1 is an axial section of one end of a tubular heat exchanger having a distributor head, taken approximately along the sectional line I—I of FIG. 4.
Figure 2:
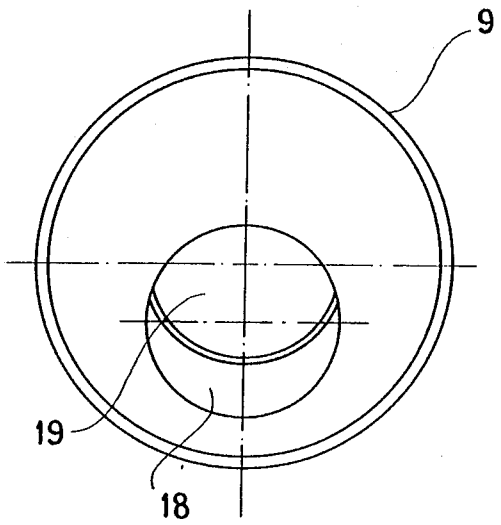
FIG. 2 is an end view of the distributor head of FIG. 1.

FIG. 1 shows the end of a tubular heat exchanger. Tubes 1–4 are located concentrically, nested inside one another. Annular chambers 5–7 are formed between these tubes. A distributor head 8 of substantially circular-cylindrical form closes off the thus-formed nest of tubes at the end.

The distributor head 8, produced as a cast part from thermally conductive material, has an outer wall 9 and an inner wall 10. Walls 9 and 10 are radially spaced and thus form a segmented, part-annular chamber 11. Chamber 11 is segmented, or interrupted by radial walls 12, 13 and connecting portion 14. The radial walls join the inner wall 10 and the outer wall 9 to one another. (See also FIGS. 3 and 4). The wider, radially extending connecting portion also connects these two walls 9, 10. An outlet 15 extends through the portion 14 to provide flow communication for the chambers 6 and 16.

An end chamber 17 is formed inside the face end between the outer wall 9 and the inner wall 10. The end chamber 17 extends over the entire radial cross section of the distributor head 8, that is, the face end of the segments of the annular chamber 11.

The end chambers 17 has an opening 18 in the transverse portion 9' of the outer wall 9, preferably radially offset. Chamber 17 also has a central, inwardly facing opening 19 in the inner wall 10. The opening 19 joins the end chamber 17 to the interior 16 of the head 8.

The outer wall 9 has a radially outwardly oriented, annular collar 20 at its free end. The outer tube 1 rests with a similar radial collar 21, with a seal 32 interposed on the collar 20. The collars 20, 21 and hence the tube 1 and outer wall 9 are compressed axially and centered with respect to one another in the radial direction by a clamping ring 23 of substantially V-shaped cross section. The clamping ring 23 can be opened in a manner not shown in detail but known per se, so that the connection between the tube 1 and the outer wall 9 of the distributor head 18 is releasable.

The tube 2 located inside the tube 1 is inserted up to a stop 24 formed by a groove in the free end of the inner wall 10. Tube 2 is sealed off from the inner wall 10 by two sealing rings 25 inserted in annular grooves of the inner wall. To increase stability, the tube 2 is provided on its end with smooth cylindrical sleeves 39 having thickened walls.

The tube 3, located coaxially inside the second tube 2, is firmly joined to a sleeve 26. Sleeve 26, in the axial direction has approximately the length of the inner wall 10 and is located radially spaced from the inside of the inner wall 10. The sleeve 26 is seated with its free end 27 in a hollowed-out portion of the inner wall 10 and is braced in axial direction against a stop 28, inwardly of the opening 19. The end 27 of the sleeve 26 is sealed off from the inner wall 10 again by two seals 29, which are sealed in annular grooves of the free end 27.

Let it be assumed that an identical distributor head 8 is located on the left-hand end (with respect to FIG. 1), not shown, of the nest of tubes 1, 2, 3, 4. A complete unit is thus formed which is joined firmly and tightly together by respective clamping rings 23. By releasing the clamping rings 23, the unit can be easily opened and disassembled into its individual parts, for example for cleaning.

A tube 4 is located inside the tube 3. The tube 4 forms a positive-displacement body for the formation of the annular cross section 7, and thus has conical closure and caps 30 at the ends. The caps 31 are in axial and radial engagement with inwardly oriented, axially parallel ribs 31. Ribs 31 extend from sleeve 26 inwardly in the region of a conical enlargement 32, located in the region of connection with the tube 3.

The radial extent of the annular chamber 7 inside the tube 3 can be determined in accordance with requirements in an individual case by the size of the tube 4. Similarly, the size of the annular chamber inside the tube 2 can be selected by the diameter of the tube 3 and suitable adaptation of the sleeve 26. The wall thickness and contour of the sleeve 26 define the cross sections of the annular chamber 33 existing between it and the inner wall 10, on the one hand, and of the flow cross sections 34 located inside the sleeve, on the other. The flow velocity of the medium carried therethrough can thus be varied.

As the drawing shows, the unit or assembly comprising the tube 3 and sleeve 26 as well as the parts therein can easily be exchanged for a unit having different dimensions, in order to modify the aforementioned flow conditions and flow cross sections.

Figure 4:
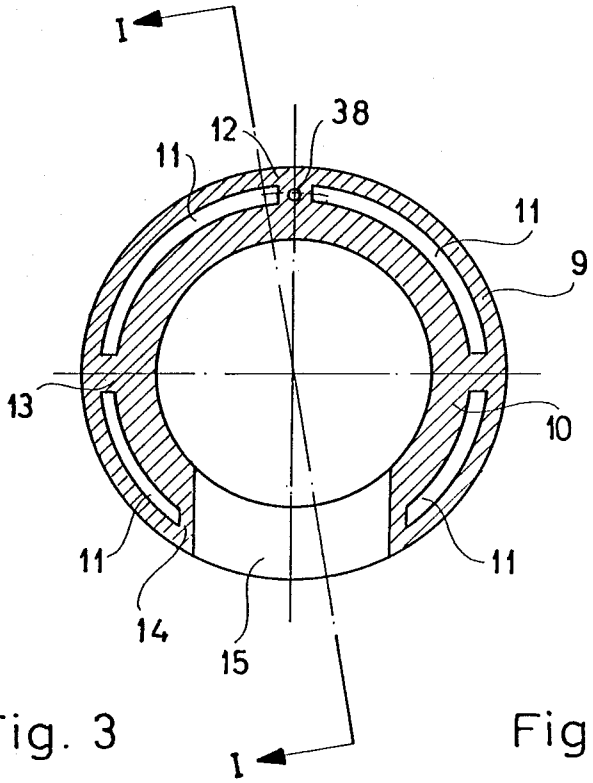
FIG. 4 is a sectional view of the distributor head taken approximately along the sectional line IV—IV in FIG. 5.
Figure 3:
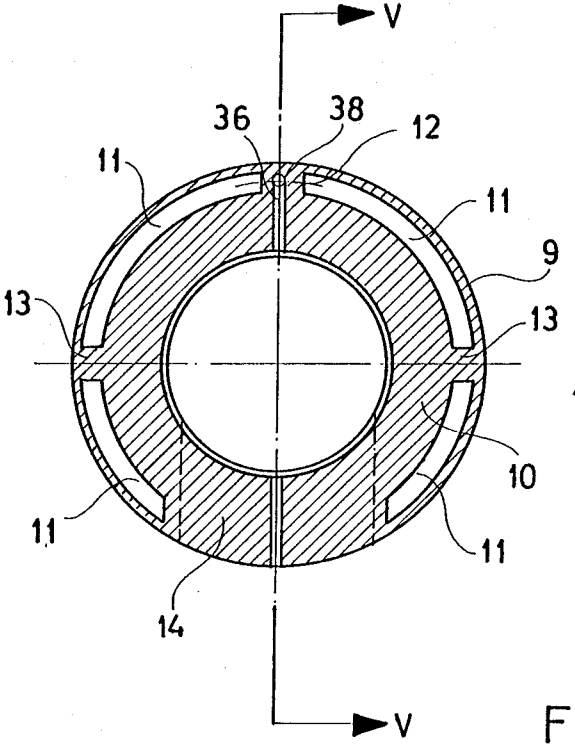
FIG. 3 is a sectional view of the distributor head taken approximately along the sectional line III—III in FIG. 5.
Figure 5:
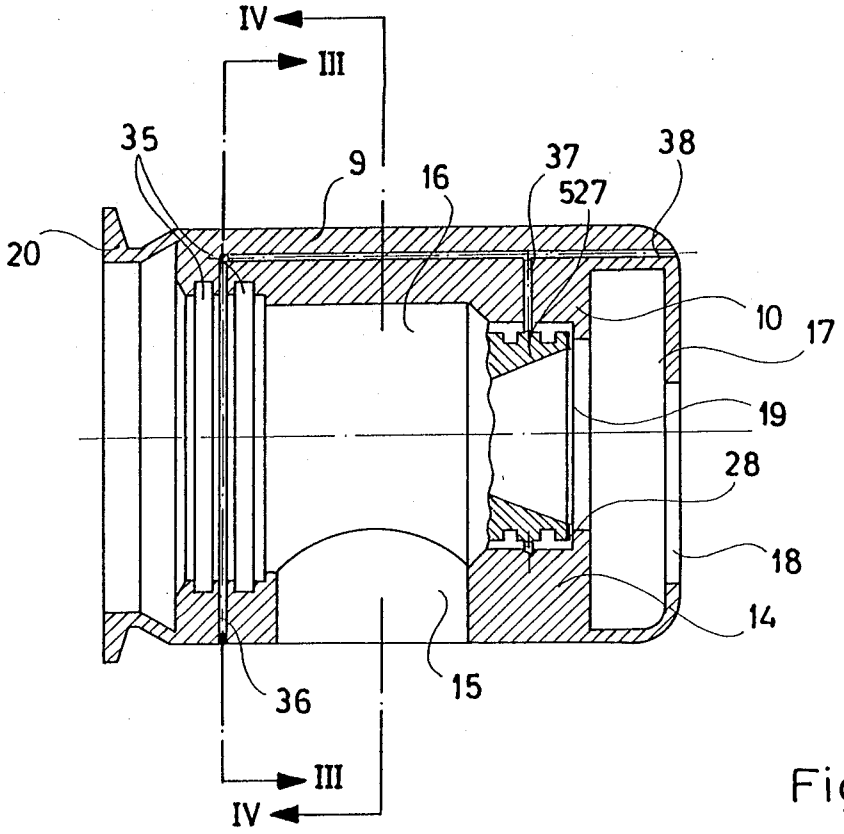
FIG. 5 is an axial section of the distributor head taken along the sectional line V—V of FIG. 3.

FIG. 5, in conjunction with FIGS. 3 and 4, shows radial and circumferential conduits 36, 37, terminating respectively between the grooves 35 of the inner wall 10 for the sealing rings 25 and the grooves of the sleeve 26 for the sealing rings 29; these conduits also terminate at an axially parallel conduit 38 inside the radial wall 12. These conduits are provided to divert leakage fluid or to introduce a blocking liquid.

FIG. 5 also shows the end 527 of the sleeve 26 in detached form, in order to indicate that instead of the insert formed by the tube 3 and the sleeve 26 of FIG. 1, a structurally different insert can also be used.

Figure 6:
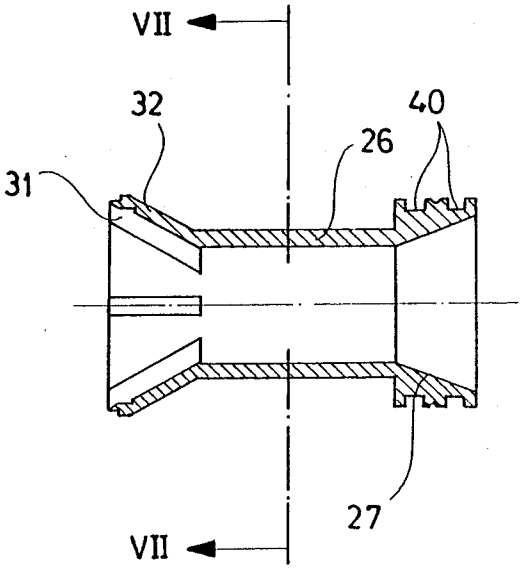
FIG. 6 shows a detail of the inner sleeve of FIG. 1.
Figure 7:
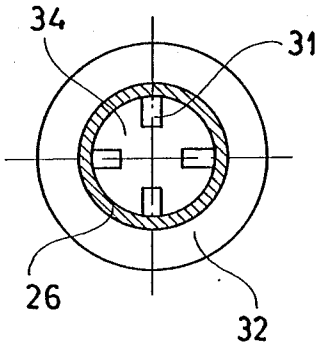
FIG. 7 is a sectional view taken along the sectional line VII—VII of FIG. 6.
Figure 8:
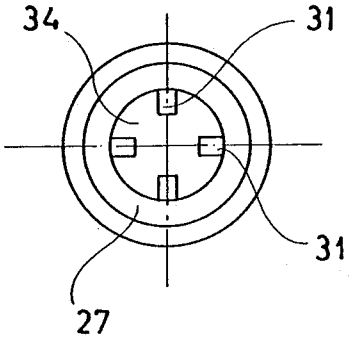
FIG. 8 is an end view of the subject of FIG. 6.

FIGS. 6–8 again show the sleeve 26 in detail, with its end parts 27 and 32, the radial extent of which with respect to the middle, restricted region, is of equal size, so that in the vicinity of the sleeve, the pressure forces exerted by the heat exchange medium are equalized.

FIG. 6 also shows annular grooves 40 for the ring seals 29 at the end 27 of the sleeve 26.

The conically enlarged end 32 of the sleeve 26 has the conically extending ribs 31, four of which are used, distributed uniformly over the circumference.

Figure 9:
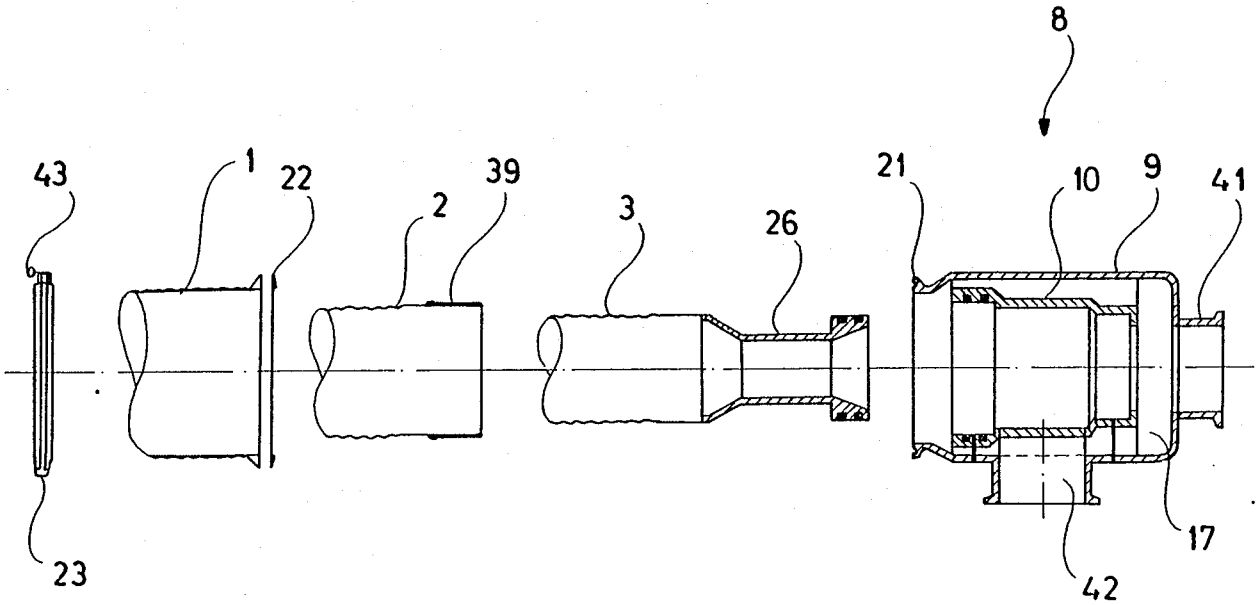
FIG. 9 is a simplified exploded view of the subject of FIG. 1.

FIG. 9 is an exploded view of the heat exchanger of FIG. 1. Connection stubs 41 and 42 for media participating in the heat exchange are shown. Stub 41 adjoins the opening 18, and the stub 42 adjoins the outlet 15. FIG. 9 also shows a clamping screw 43, with which the clamping ring 23 can be opened and closed.

OPERATION

One of the media participating in the heat exchange flows via the opening 18 into the end chamber 17, then in one path through the annular chambers 11 between the outer wall 9 and the inner wall 10, then by the annular chamber 5 between the tubes 1 and 2; and by another path, through opening 19 of the wall 10 in the interior 34 of the sleeve 26, as well as into the annular chamber between the tubes 3 and 4.

The other heat exchange medium flows via the opening 15, the annular chamber 33 between the inner wall 10 and sleeve 26, and the annular chamber 6 between the tubes 2 and 3. In a known manner, the flow can be in the same direction or in a countercurrent. To generate good turbulence in the media participating in the heat exchange inside the tubes 1–4, these tubes, as the drawing shows, are formed as corrugated tubes, with the corrugation suitably extending helically. Naturally, in order to provide the necessary attachment connections, the tubes change at their ends into smooth cylindrical segments.

Figure 10:
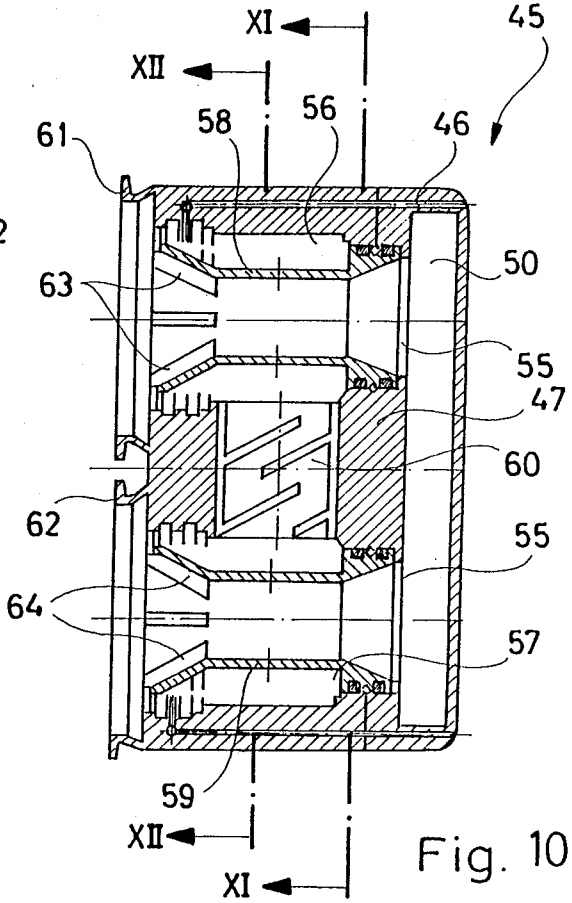
FIG. 10 is an axial section of two distributor heads formed as a twin head.
Figure 11:
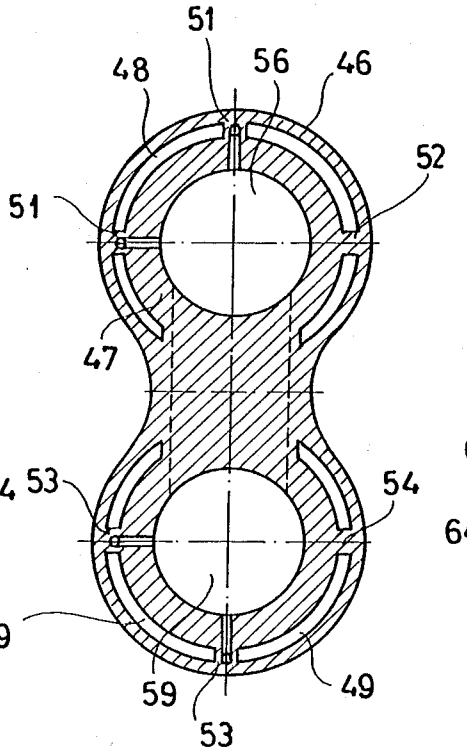
FIG. 11 is a sectional view taken along the sectional line XI—XI in FIG. 10.
Figure 12:
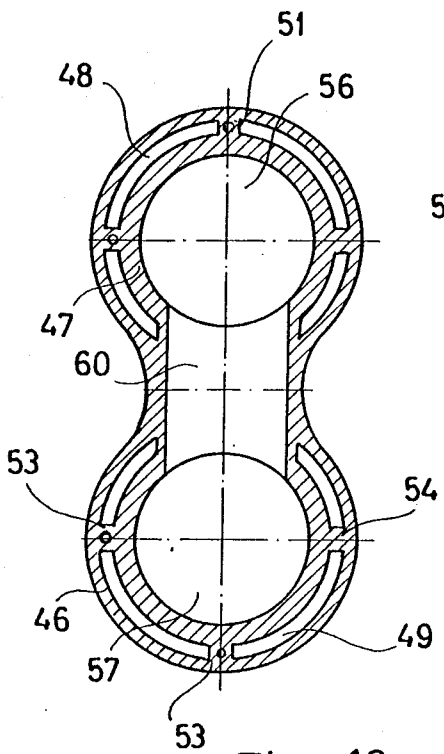
FIG. 12 is a sectional view along the sectional line XII—XII in FIG. 10.

FIGS. 10–12, in axial section and in two sectional views along the sectional lines XI—XI and XII—XII in FIG. 10, show a twin version of the distributor head described thus far, which can be imagined as being produced by two distributor heads 8 of FIG. 1, rotated mutually about their axes by 180°, and placed against one another with their outlet openings 15 oriented toward one another and "fused" to one another in this region.

in this way, the distributor head 45 of FIG. 10 is produced, which in view of the foregoing description will now be described only in its essential details.

The double distributor head 45 has an outer wall 46 having a circumferential contour substantially in the shape of a FIG. 8 as well as an inner wall 47 likewise having a circumferential contour in a FIG. 8, the two walls being radially spaced from one another and thus forming annular chambers 48, 49, which are connected to a common end chamber 50 and thus are joined together.

Once again, the annular chambers are segmented by radial walls 51–54 for the connection of the outer wall 46 and inner wall 47, the radial walls 51 and 53 having bores for diverting leaking medium, in the manner described above.

Respective inner chambers 56, 57 are formed inside the interior of the inner wall 47, which has two openings 55 to the end chamber 50. Respective sleeve elements 58, 59 of the type described are inserted in chambers 56, 57; the interior chambers 56, 57 merge with outlets, which here join together into a common flow duct 60 between the two interior chambers. The sleeves 58 and 59 are not shown in FIGS. 11 and 12.

The outer wall 46, on the side opposite the end chamber 50, forms two annular collars 61 and 62 beside one another, each of which can be coupled to a respective nest of tubes of the type described above, in the manner also described above. In this way, two such nests of tubes are connected in series with one another in terms of associated flow paths, yet without requiring a different embodiment at the ends of the nest of tubes or additional connecting elements, for connecting the two heat exchangers represented by the nests of tubes with one another. The inner wall 47 and the sleeves 58 and 59, along with their ribs 63 and 64, are also formed to fit, in the manner described above, for attachment of the nest of tubes.

Figure 13:
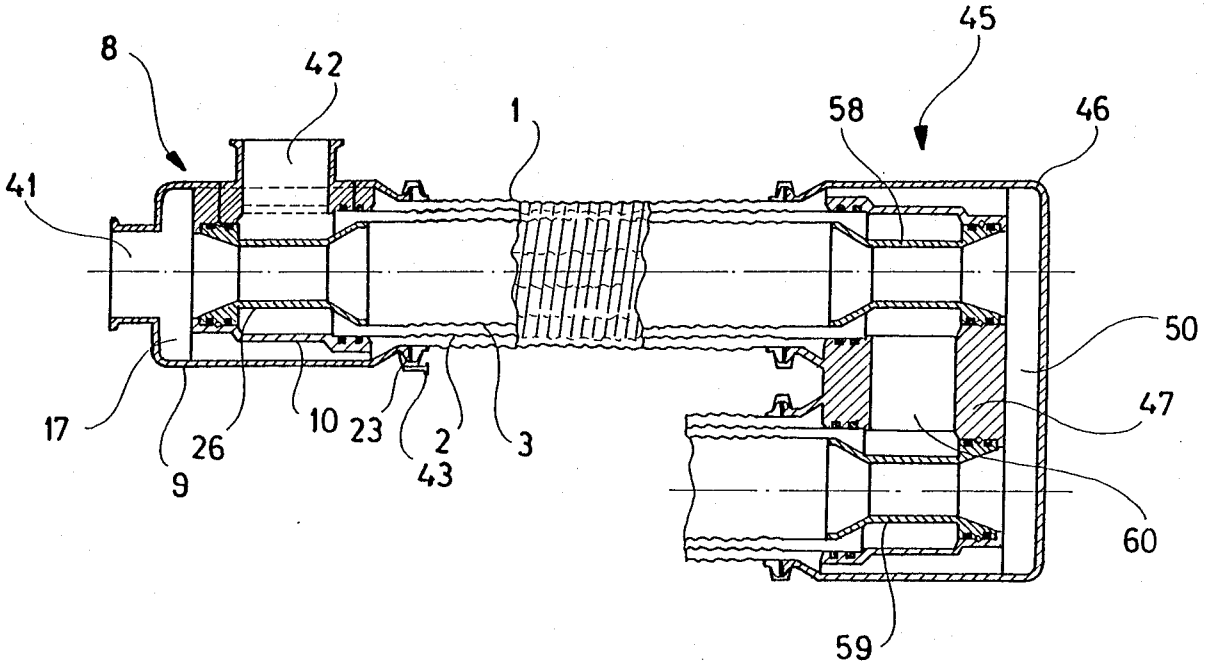
FIG. 13 is a simplified, fragmentary and sectional view of two heat exchangers connected in series and having a twin head.

FIG. 13 is a simplified general view, to show the series connection of two nests of tubes of two heat exchangers of the type according to the invention, wherein the connection to the two media carried for heat exchange is effected via a distributor head 8 and the connection of the two heat exchangers is effected via a double distributor head 45. A distributor head 8 then again adjoins the end of the nest of tubes which originates at this double distributor head and which is shown only in fragmentary form.

Figure 14:
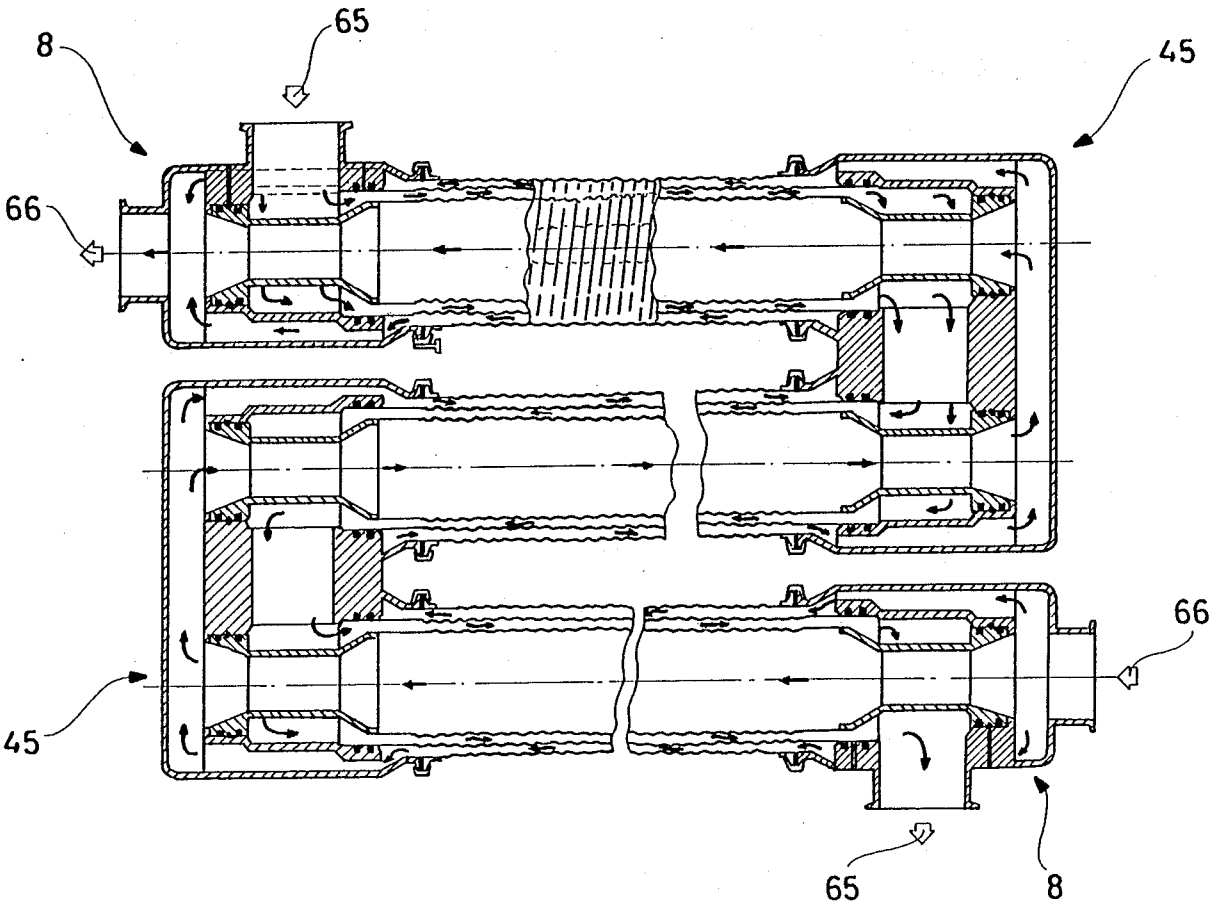
FIG. 14 is a schematic sectional view of the three series-connected heat exchangers.

FIG. 14 shows the series connection of three heat exchangers having two distributor heads 8 for connection to two media 65 and 66 carried in counter current to one another, as well as tow double distributor heads 45 for interposition of the middle heat exchanger between the first and third heat exchangers; the possibility for compact and simple connection, while at the same time completely including the distributor heads in the heat exchange process, is apparent here.

Figure 15:
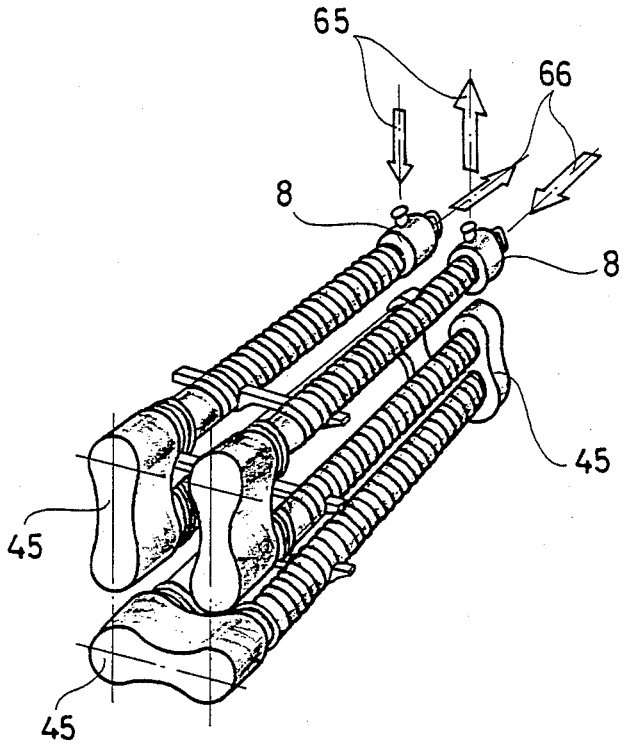
FIG. 15 is a simplified perspective view of a plurality of series-connected tubular heat exchangers.

While in FIG. 14 a plurality of heat exchangers are still located in one plane beside one another, FIG. 15, in a perspective view, shows the series connection of six heat exchangers with the additional option that heat exchangers, in succession via the double distributor heads 45, can also be connected in planes that are rotated with respect to one another.

The outermost tube 1 and the outer wall 9 of the head 8 are coupled by the radially outwardly oriented collars 20, 21 and the clamping ring 23, surrounding both collars on the outside and having a substantially V-shaped cross section. This is an efficient connection to the tube 1 and wall 9 with respect to one another and axially brace them against one another; in a manner known per se, the end of the second tube 2 and the end of the sleeve 26 are sealed off via sealing rings 25, 29 inserted into annular grooves of the inner wall and of the sleeve end, respectively.

Another advantage is that the outer and the inner wall 9, 10 of the distributor head 8 are secured together by the ribs 13. This permits forming radial outlet 15 as well as the axial opening 18, while still providing a stable distributor head 8 capable of withstanding heavy loads, which further can easily be manufactured as a cast part. The thickness of the radial wall or a plurality of walls, and the radial spacing between the inner and outer wall, can be suitably selected so that the size of the annular chamber 11 in the distributor head, which is connected to the annular chamber 5 located between the first and second tube 1, 2, can be varied. Thus, the flow velocity inside the annular chamber 5 can be varied. A corresponding variation is attainable via the selection of the wall thickness of the sleeve 25 or of the inside clear cross section remaining inside the sleeve forming the flow chamber inside the third tube 3.

Advantageously, inside the third tube of the nest of tubes, the further, fourth tube 4 is located spaced radially from the third tube 3, in order to determine the gap size of the flow cross section insider the third tube 3 and thus determine the flow velocity therethrough.

The fourth tube 4 has conical closure caps 30 on both ends. It is held in position at the closure caps 30 and by at least three radially inwardly oriented, axially parallel ribs 31, formed at the end of the sleeve 26. Sleeve 26 is joined to the third tube. Thus, tube 4 and cap 20 are braced radially and axially. The fourth tube 4 and cap 30 form a sealed-off positive-displacement body for the medium carried inside the third tube 3, i.e. in tube chamber 7.

In all the embodiments described, it is desirable that the tubes 1–4 are formed as corrugated tubes having an annular or helical corrugation. Be selecting the type of corrugation, the flow turbulence of the media in heat exchange with one another can be varied. Naturally other forms of the tubes that increase the heat exchange output can also be used herein.

In accordance with a further feature of the invention, a heat exchanger can be directly coupled to another similar one to form series-connected heat exchangers, see FIGS. 10–15. The nest of tubes of two successive heat exchanger units 8 are located adjacent and parallel to one another. The distributor heads are located adjacent one another to form a combined head 45 (FIG. 10). The flow paths of the two units are combined into an integral unit, in which the end chambers on both ends and radial outlet cross sections integrally merge directly with one another, so that openings in the outer wall of the end chambers can be omitted.

As a result of this embodiment according to the invention, two distributor heads 8 located beside one another form a series connection of the heat exchangers. According to a feature of the invention, they are combined into the twin head 45 (FIG. 10), each half of which has the essential characteristics of the core of the invention. The two heads are joined together in the manner of Siamese twins in such a way that the zones for the inflow or outflow of the two media that are in heat exchange with one another merge directly with one another. No additional connection and attachment means whatever are needed; and at the same time, as a result of the distributor heads thus joined together, a single component is provided which supports the heat exchangers located beside one another in common and holds them at the correct spacing with respect to one another. This single component can also be produced easily in one operation as a cast part, and also has, for each of the two heat exchangers thus joined together, all the above-described advantages of the invention.

I claim:

1. A heat exchanger having at least three tubes (1, 2, 3, 4) of thermally conductive material arranged coaxially within one another in a nest, and spaced radially from one another, the spacing between said nested tubes defining fluid medium flow chambers (5, 6, 7);

means (18, 19; 15) for introducing at least two heat exchange media in the heat exchange medium flow chambers formed between the tubes;

at least one distributor head (8, 45) coupled to said tubes to form, with the tubes, an axially coupled unit and to provide a flow connection for the heat exchange media as well as an end retaining means for the tubes, said tubes and the heads being coupled in fluid-tight manner, the heads (8) being formed with an inner space communicating with the chambers (5, 6, 7) between the tubes (1, 2, 3, 4), wherein, in accordance with the invention, each distributor head (8, 45) has two substantially cylindrical walls (9, 10; 46, 47) concentric with respect to each other and radially spaced within one another, defining a substantially annular chamber (11) between said walls, said walls being integrally connected;

an end wall (9a) extending transversely from the outer wall (9) and defining therebeneath an end chamber (17, 50), said end chamber communicating with the essentially annular chamber (11), said end chamber extending inside the outer wall (9) over the entire radial cross section of the outer wall;

means (20, 21, 23) for sealingly securely and releasably coupling the outer wall (9, 46) to the outermost (1) of said plurality of tubes forming the nest of tubes, said coupling means generating an axial clamping force between said outer wall (9, 46) of the head (8, 45) and said outermost tube (1);

a first stop (24) formed on the inner wall (10);

a second inner tube (2) of said plurality of tubes being inserted into said inner wall (10, 47) and fitting against said axial stop;

a second stop (28) positioned axially closer to said transversely extending end wall (9a) than said first stop formed in the inner wall (10, 47);

a hollow-cylindrical sleeve (26; 58, 59) positioned with said inner wall, axially retained against said second stop, and spaced radially from the inner wall (10), said sleeve having an inner chamber (34) communicating with the end chamber (17) and defining, between the outer wall of the sleeve and the inner wall (10) of the head, an inner chamber (16);

a third tube (3) of said nest of tubes, located radially spaced within said second tube (2) and sealingly connected to said sleeve (26; 58, 59), said inner chamber (16) communicating with a second chamber (6) formed by the radial spacing between the second and third tubes (2, 3);

a radially extending connecting portion (14) between said inner (10) and outer (9) walls of the head (8);

and a radial flow connection (15, 60) in said connecting portion (18) extending, without fluid communication, across the part-annular chamber (11) to provide for flow communication to the second chamber (6) formed between the second and third tubes (2, 3) for fluid flow through said second flow chamber by another heat exchange medium.

2. The heat exchanger of claim 1, wherein said sealing and coupling means (20, 21, 23) comprise a laterally radially extending collar or flange (20, 61); formed on the outer wall (9, 46) of said head;

a matching radially extending collar or flange (21, 62) formed on the outer one of said tubes (1) fitted against the flange (20, 61) of said outer wall (9, 46);

and a clamping ring (23) surrounding both collars or flanges at the outside, said clamping ring being essentially of V-shaped cross section, for centering the head (8, 45) with respect to the outermost one (1) of said tubes and axially connecting and bracing said head and tube together.

3. The heat exchanger of claim 1, further including sealing rings (29) positioned adjacent an end portion (27, 527) of the sleeve (26) and sealing said end portion against the inner wall (10) in the region of said second stop (28).

4. The heat exchanger of claim 1, further including two sealing means (26; 58, 59) sealing the end of the second tube (2) against the inner wall (10) of the head (8, 45) in the region of said first stop (24).

5. The heat exchanger of claim 1, wherein radially extending ribs (12, 13; 51, 52, 53, 54) are provided connecting the inner wall (10, 47) and the outer wall (9, 46) of the distributor head (8, 45) to connect said walls into a sturdy unitary element, said connection portion (14) extending radially between said inner and outer wall.

6. The heat exchanger of claim 1, wherein a fourth tube (4) is provided, nested within and radially spaced from the third tube (3);

and means (35) for retaining said fourth tube in position within said third tube.

7. The heat exchanger of claim 6, further including an essentially conical closure cap (30) closing off said fourth tube to form a fluid flow directing element located within said third tube;

and wherein the means for retaining said fourth tube comprises radially inwardly directed ribs (31; 63, 64) connected to said sleeve (26; 58, 59) radially and axially engaging the closure cap, and retaining the closure cap and said fourth tube (4) connected thereto in axial and radially predetermined position within said third tube.

8. The heat exchanger of claim 1, wherein at least one of said tubes is formed as a corrugated tube having annular or helical corrugations.

9. The heat exchanger of claim 1, wherein said tubes (1, 2, 3, 4) are formed as corrugated tubes having annular or helical corrugations.

10. The heat exchanger of claim 1, wherein the second tube (2) is longer than said first and outermost tube (1).

11. The heat exchanger of claim 1, further including smooth-cylindrical sleeve ends (39) secured to the ends of the second tube (2) and fitting against said first stop (24), said smooth-cylindrical sleeve ends being secured to said second tube and having a wall thickness greater than the material of the tube.

12. The combination of at least two heat exchangers, as claimed in claim 1, wherein the heat exchangers are, essentially, identical and each heat exchanger includes said at least three tubes (1, 2, 3, 4);

and wherein a twin cross-connected distributor head (45) is provided, coupled to said tubes, said twin distributor head having two parallel substantially cylindrical radially spaced walls (46, 47), each defining a substantially annular chamber between said walls, and an integral end wall extending transversely from the outer wall and defining therebeneath an end chamber (50) and extending inside the outer walls over the entire cross section thereof;

two means for sealingly securely and releasably coupling the outer wall (46) to each of the outermost (1) of each of the plurality of tubes forming the nests of tubes, said coupling means generating axial clamping forces between the outer walls (46) of the head and said outermost tubes (1);

a radially extending connecting portion (14) between the outer wall and the two inner walls of the head (45) and a radial flow connection (60) in said connecting portion (18) extending, without fluid communication, across said part-annular chamber (11) to provide for flow communication to the second chambers (6) formed between the second and third tubes (2, 3) of the respective nests of tubes.

* * * * *